US010590543B1

(12) United States Patent
Hashimotodani et al.

(10) Patent No.: US 10,590,543 B1
(45) Date of Patent: Mar. 17, 2020

(54) METHOD FOR SURFACE-FINISHING PLASTICALLY-DEFORMED METAL LINER AND METAL LINER SURFACE-FINISHED BY THE METHOD

(71) Applicant: Samtech International, Inc., Carson, CA (US)

(72) Inventors: Naoki Hashimotodani, Torrance, CA (US); Tomonori Kubota, Gardena, CA (US); Masahiko Fumimoto, Torrance, CA (US); Huu Minh Nguyen, Westminster, CA (US)

(73) Assignee: Samtech International, Inc., Carson, CA (US)

( * ) Notice: Subject to any disclaimer, the term of this patent is extended or adjusted under 35 U.S.C. 154(b) by 0 days.

(21) Appl. No.: 16/269,961

(22) Filed: Feb. 7, 2019

(51) Int. Cl.

| | |
|---|---|
| ***C23F 1/04*** | (2006.01) |
| ***C23F 1/36*** | (2006.01) |
| ***F17C 1/14*** | (2006.01) |

(52) U.S. Cl.
CPC ..... *C23F 1/04* (2013.01); *C23F 1/36* (2013.01); *F17C 1/14* (2013.01); *F17C 2201/0109* (2013.01); *F17C 2203/0604* (2013.01); *F17C 2203/0646* (2013.01); *F17C 2209/21* (2013.01); *F17C 2209/232* (2013.01)

(58) Field of Classification Search
CPC ..... C23F 1/04; C23F 1/36; F17C 1/14; F17C 2209/232; F17C 2209/21; F17C 2201/0109; F17C 2203/0604; F17C 2203/0646
See application file for complete search history.

(56) References Cited

U.S. PATENT DOCUMENTS

| | | | | |
|---|---|---|---|---|
| 2,541,901 | A * | 2/1951 | Zademach | C23G 1/00 216/92 |
| 3,898,095 | A * | 8/1975 | Berdan | C23F 1/36 134/3 |
| 4,113,549 | A * | 9/1978 | Brimm | C23F 1/02 216/100 |
| 4,339,282 | A * | 7/1982 | Lada | C23F 1/44 134/3 |
| 4,921,565 | A * | 5/1990 | Slysh | C23F 1/08 156/345.23 |
| 5,822,838 | A | 10/1998 | Seal et al. | |
| 6,203,716 | B1 * | 3/2001 | Jurisich | C23F 1/04 216/100 |
| 6,886,711 | B2 | 5/2005 | Sakaguchi et al. | |
| 9,433,995 | B2 | 9/2016 | Chalandon et al. | |
| 2005/0260372 | A1 * | 11/2005 | Matsuoka | B29C 49/04 428/35.7 |

* cited by examiner

*Primary Examiner* — Anita K Alanko
(74) *Attorney, Agent, or Firm* — LambentIP

(57) ABSTRACT

A method for surface-finishing one or more metal liners is provided, the method comprising chemical milling to remove wrinkled textures generated during the plastic deformation of the metal liners.

6 Claims, 8 Drawing Sheets

METHOD FOR SURFACE-FINISHING PLASTICALLY-DEFORMED METAL LINER AND METAL LINER SURFACE-FINISHED BY THE METHOD

BACKGROUND

A pressure vessel is a large-scale apparatus used for containing gases or liquids at above atmospheric pressure. A high-pressure gas tank (or cylinder) is a type of pressure vessel. Examples of the gases or liquids may be hydrogen, helium, oxygen, nitrogen, natural gas, petroleum gas, etc. to be used in automotive and aerospace industries as a propellant, a carrier gas, a diluent gas, a fuel component, etc. These pressure vessels are subject to extreme variations in pressure and temperature; thus, safety and reliability are of a paramount concern in designing such pressure vessels. Some pressure vessels are made of composite materials, such as carbon fiber impregnated with epoxy resin, wound around a metal liner for reinforcement. While high-performance carbon fibers offer high strength-to-weight ratios, the metal liner prevents gas-leakage and provides sturdiness, typically made of aluminum, titanium, alloy, or stainless steel. For lightweight, high-pressure gas containment, aluminum or aluminum alloy is generally a material of choice.

A metal liner for a high-pressure gas tank may be formed to be axially symmetric in shape, having a body section that is used as a main compartment for the gas containment and is shaped to be a generally cylindrical shell, i.e., a generally hollow cylinder elongated in the axial direction, a neck section that is shaped to be a generally narrow tube having a passage therein for discharging the gas from one end of the cylindrical shell, and a shoulder/dome section formed to connect the cylindrical shell and the narrow tube. A valve and fitting may be attached to the neck section for connecting to an external apparatus. The neck sections may be formed at both ends to provide passages for the gas to/from external apparatuses or the ambient.

Spin forming, also known as metal spinning or flow forming, is a manufacturing process, wherein a workpiece such as a disc or tube of metal is rotated at high speed around its cylindrical axis on a mandrel and formed into an axially symmetric part. Spin forming does not involve removal of material, as in grinding or etching, but plastically deforms the workpiece into a final shape. Spin forming often involves a necking process, also known as reducing or closing, wherein a roller, a spoon or other forming tool is pressed against the outer periphery of the workpiece to gradually deform a predetermined portion to have a smaller diameter as it spins, giving rise to a seamless axially symmetric structure having a gradually changing diameter as going along the axial direction. Drawing or cold drawing is another technique for plastic deformation.

Although spin forming techniques have been around since ancient days, the use of spin forming to form metal liners of pressure vessels, especially for aerospace applications, is relatively new. For example, the U.S. Pat. No. 5,822,838 (Seal et al.) discloses the use of spin forming to form domes, based on titanium alloys, followed by heat treatment and machining to remove oxygen-enriched material; the spin-formed domes are then welded to both ends of a cylindrical body to form the liner of a composite overlapped pressure vessel. In another example, the U.S. Pat. No. 6,886,711 (Sakaguchi et al.) discloses the use of spin forming to form a cylindrical shell, based on aluminum alloy, having at least one end open with the maximum wall thickness and a region with a gradually reduced wall thickness connecting to a cylindrical body having the thinnest wall, followed by necking to form a dome section and a neck section with a gradually increasing wall thickness going from the body section to the necked end.

One advantage of spin forming is that several operations can be performed in one set-up, and thus tooling and production costs are comparatively low. Additionally, plastic deforming processes in general waste a considerably less amount of material than other methods, and can build a part having multiple sections without seams by starting from one piece of material. Without seams, a part can withstand high internal or external pressures. However, one inherent disadvantage of plastic deformation is that microscopic folds, wrinkles and other unevenness may likely occur on the surface, developing local stress and fatigue that can eventually lead to cracks or fractures.

High-quality finish of metal surfaces is often required for various mechanical parts to enhance the quality, reliability and safety. Tight requirements are imposed on the fabrication of high-pressure gas cylinders including metal liners, for example, in aerospace engineering and other high-technology applications. In this regard, comprehensive and effective processing techniques are urgently needed to achieve extremely high-quality finish for key metal parts deployed in these areas.

DETAILED DESCRIPTION

Figure 1:
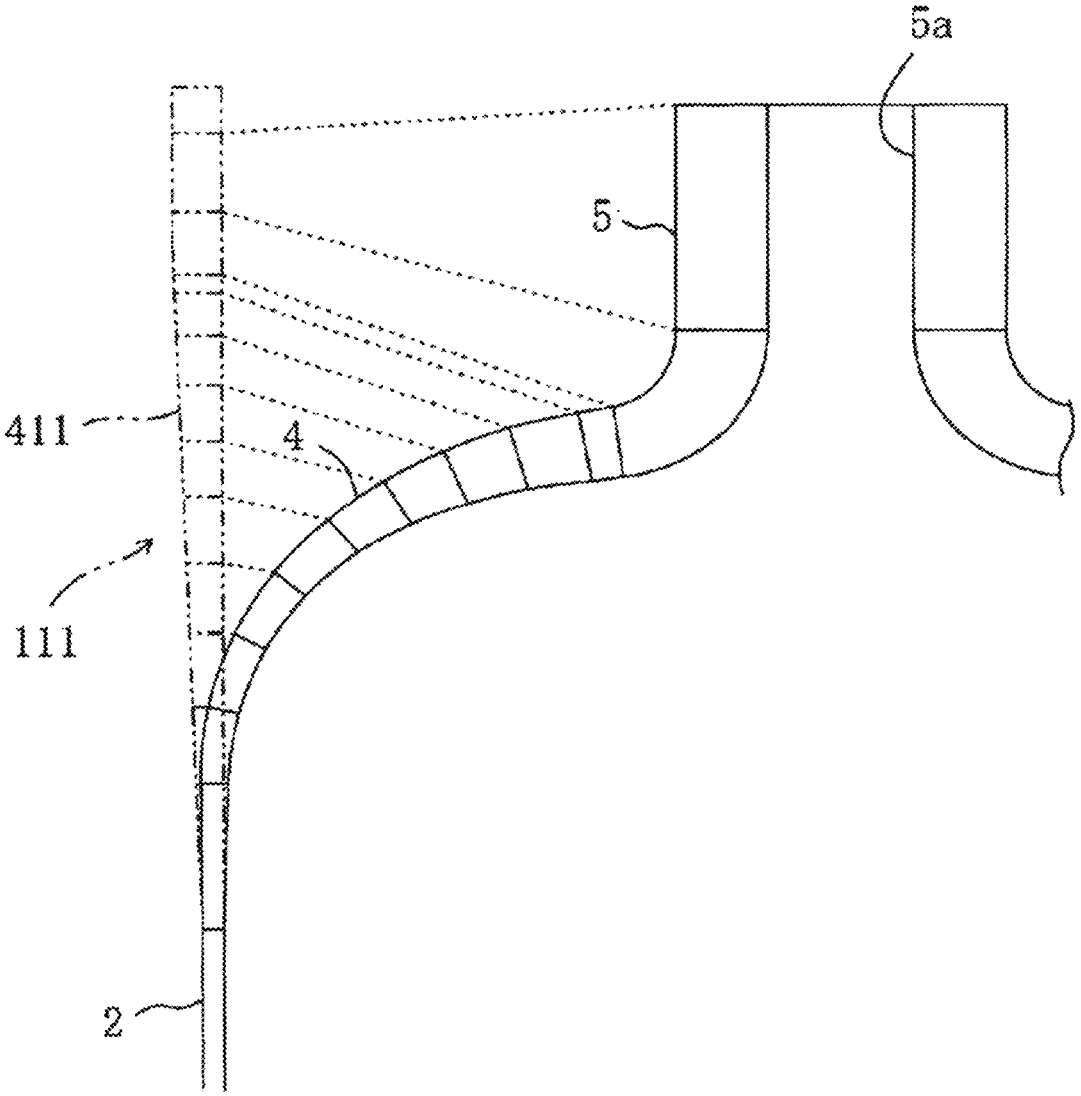
FIG. 1 (Prior Art)
FIG. 1 (Prior Art) illustrates a partial cross-sectional view of an example of a high-pressure tank fabricated by a prior art method.

FIG. 1 (Prior Art) illustrates a partial cross-sectional view of an example of a high-pressure tank fabricated by the method described in the aforementioned U.S. Pat. No. 6,886,711 (Sakaguchi et al.). The high-pressure tank therein is a metal liner based on aluminum alloy, for example, for containing the content, e.g., a pressurized gas. The metal liner is formed to be axially symmetric in shape, comprising: a body section 2 shaped to be a generally cylindrical shell with a predetermined wall thickness, i.e., a generally hollow cylinder elongated in the axial direction; a shoulder/dome section 4 formed seamlessly contiguous to one end of the cylindrical body section 2; and a neck section 5 (5*a*) that is extruded seamlessly contiguous to the dome section 4 to form a generally narrow tube having a passage therein to channel the content (via charging or discharging) to/from the ambient or an external apparatus. At the other end opposite to the one end of the cylindrical body section 2, a second neck section and a second dome section seamlessly and contiguously connected thereto may be formed to provide a second passage to channel the content (via charging or discharging) to/from the ambient or an external apparatus.

The method to form a metal liner, such as exemplified in FIG. 1, may involve two spin forming steps. In the first spin forming, a workpiece having a shape of a generally hollow cylinder with a predetermined wall thickness is rotated around its cylindrical axis, while a forming tool is pressed against the outer periphery of the workpiece with a varying force as moving along the axial direction, so as to deform the wall of the workpiece to result in a workpiece cylinder 111 having the wall thickness at its maximum at an open end portion, gradually decreasing as going down from the open end portion of an end region 411, vertically along the end region 411, to the body section 2. The same procedure may be performed to similarly configure the wall thickness of the other end region of the workpiece cylinder 111. In the second spin forming, the workpiece cylinder 111 with the gradually varied wall thickness is rotated around its cylindrical axis, while a forming tool is pressed against the outer periphery of the end region 411 to form the dome section 4 seamlessly contiguous from the body section 2 to extrude the neck section 5 (5*a*) seamlessly contiguous from the dome section 4. The same procedure may be performed to similarly configured the neck section and the dome section on the other end.

As mentioned earlier, plastic deforming processes such as spin forming, drawing, etc. can build a part having multiple sections without seams by starting from one piece of material. Without seams, a part can withstand high internal or external pressures. In the case of a plastically deformed metal liner, the stress due to high pressure is concentrated around the neck section 5 (5*a*) and the dome section 4. By forming the wall thickness of the neck section 5 (5*a*) and the dome section 4 thicker than that of the body section 2, as illustrated in FIG. 1, the metal liner can be made to withstand even higher pressures. One inherent disadvantage of plastic deformation, however, is that microscopic folds, wrinkles and other roughness or unevenness may likely occur on the surface, developing local stress and fatigue that can eventually lead to cracks or fractures. The severity of such roughness or unevenness depends on various factors such as the necking ratio (i.e., the ratio between the pre- and post-necking diameters), the wall thickness of the workpiece, the shape and conditions of the mandrel used for the spin forming, the spinning speed and temperature, etc. Even with the carefully controlled process parameters, the formation of wrinkled textures including microscopic folds and wrinkles is inevitable in the present-day plastic deformation techniques.

Thus, surface finishing processes are often required for plastically-deformed metal parts. Examples of industrial finishing processes include: grinding, buffing, blasting, etc. for mechanically removing and reshaping microscopic folds, wrinkles and other roughness or unevenness of the surface. A plastically-deformed metal liner, as it is, often has wrinkled textures primarily on the internal and external surfaces of the dome section 4. However, metal liners are typically shaped to have internal geometries impossible for such machining tools to reach. For example, for high-pressure gas containment, the narrow passage in the neck section 5 (5*a*) may be in the range of 0.8-4.5 cm in diameter, while the dome section 4 expands almost horizontally like a shoulder from the root of the neck section 5 (5*a*) to connect to the body section 2. The internal diameter of the body section 2 may be in the range of 4.3-56 cm. This makes it impossible to use machining tools to reach the internal surface of the dome section 4 for grinding, buffing, blasting, etc. for mechanically removing and reshaping the wrinkled textures thereof. Instead of using machining tools for grinding or polishing, heat treatments such as annealing and quenching may be applied for smoothening the surface. However, these conventional methods largely depend on physical and chemical properties of the alloy constituents and related complex thermodynamics, thereby being difficult to reach consistent results each time. Furthermore, a heat treatment often results in generation of grain boundaries due to clustered constituents, potentially leading to an alternate set of surface defects. Additionally, heat treatments in general are not effective for removing microscopic folds and wrinkles resulted from plastic deformation.

The present invention provides a surface-finishing method that is especially effective for smoothening wrinkled textures inherently generated on surfaces of plastically-deformed metal liners. High-quality surface finish is often demanded for pressure vessels such as high-pressure gas tanks (or cylinders), to enhance the reliability and safety. Details of the present method are explained below with reference to accompanying drawings. Although specific values are cited herein to explain the method, it should be understood that these are approximate values and/or within instrumental tolerances or resolutions.

FIGS. 2A-2H illustrate an example of the process flow describing the present method for surface-finishing a plastically-deformed metal liner. In this example process, the workpiece is a metal liner having top and bottom extruded neck sections contiguously and seamlessly connected to top and bottom shoulders/dome sections, respectively, which are further contiguously and seamlessly connected to the top and bottom ends, respectively, of a cylindrical hollow body section. A partial cross-sectional view of an example shape is illustrated in FIG. 1 with the reference numerals of the neck section 5 (5*a*), the dome section 4 and the body section 2. The present surface-finishing method to follow the plastic deformation process is a type of chemical milling or etching. In general, chemical milling or etching uses baths of temperature-regulated etching chemicals, i.e., etchants, to remove material from an object for reshaping or smoothing the surface, essentially involving chemical reactions to dissolve the solid material. Inert substances, i.e., maskants or resists, may be used to protect specific areas of the object during the chemical reactions. In the present method, as illustrated in FIGS. 2A-2H, an entire metal liner is bathed and subject to chemical reactions without maskants or resists to protect specific areas; thus, preparatory masking steps are unnecessary.

Figure 2A:
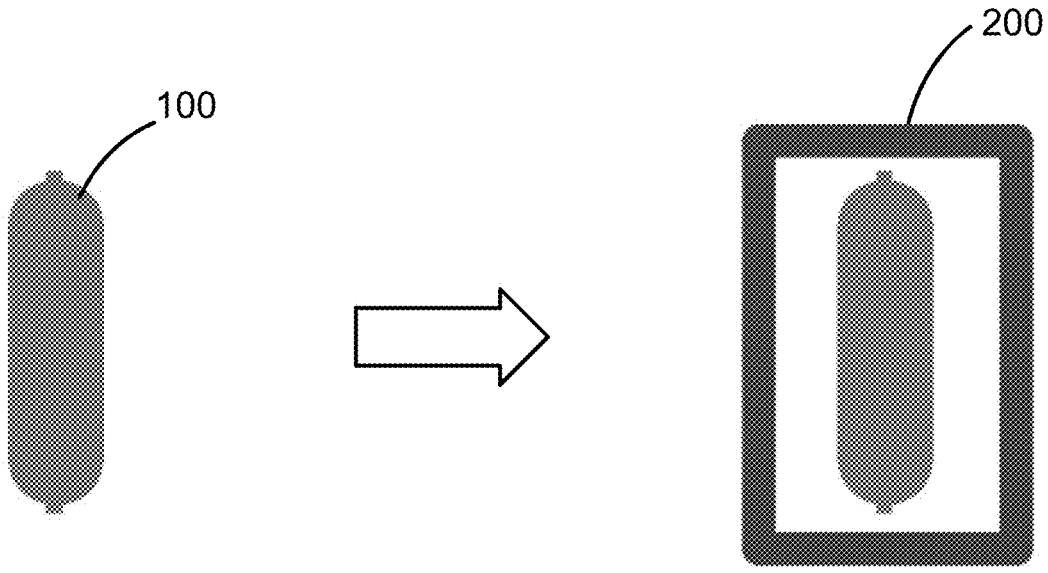
FIGS. 2A-2H illustrate an example of the process flow describing the present method for surface-finishing a plastically-deformed metal liner.

In a first step illustrated in FIG. 2A, a plastically-deformed metal liner 100, made of an aluminum alloy, for example, is housed in a rack 200. The rack 200 may comprise a frame corresponding to 12 edges of a rectangular cuboid and multiple support beams in between, and may be made of iron, plastic, rubber or other materials resilient to the etchants to be used. The rack 200 may further comprise inwardly-extending arms to hold and secure the metal liner 100 therein. The rack 200 may be dimensioned to accommodate one or more metal liners 100. For example, the rack 200 may be dimensioned to be L×W×H (inch)=57×29×78 for accommodating two metal liners 100 of a medium size. One or more pairs of inwardly extending arms may be attached internally to the rack 200 and configured to hold the top and bottom neck sections of one or more metal liners 100, respectively. The following steps can thus be carried out for surface finishing one or more metal liners 100 simultaneously, although the example process illustrated in FIGS. 2A-2H shows only one metal liner 100.

Figure 2B:
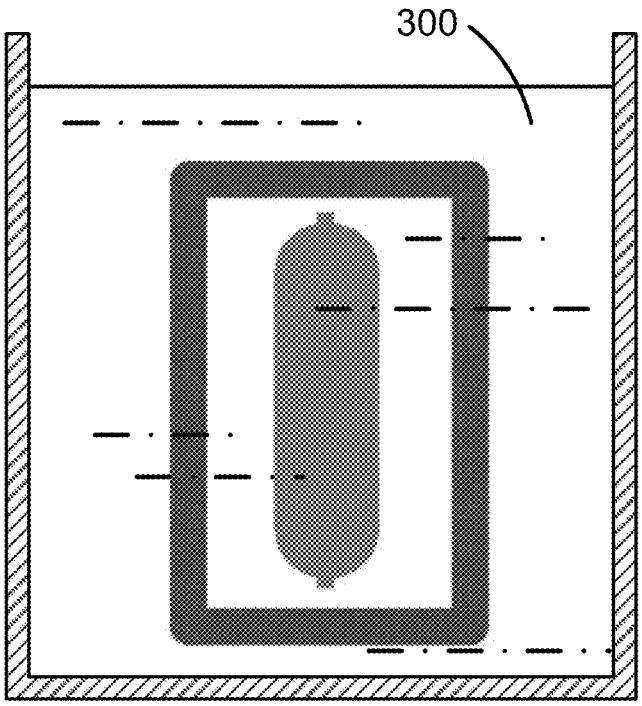

In a second step illustrated in FIG. 2B, the unit of the rack 200 and the metal liner 100 housed therein is immersed in a bath of the etching solution 300, which may comprise sodium hydroxide (NaOH) as the main component, mixed with sodium sulfide ($Na_2S$), triethanolamine and a solvent such as water. NaOH is a highly caustic base and alkali, capable of dissolving aluminum well but not iron. Thus, the NaOH-based chemical etching is effective and suited for a metal liner made of aluminum or aluminum alloy housed in a support rack made of iron. The etching rate varies depending on various factors, including the concentration and composition of the etching solution, the material to be etched, the length of immersion time and the temperature. The optimal parameter values can be determined experimentally prior to the etching process. In one example process using the NaOH-based etching solution for a metal liner made of aluminum alloy, the temperature of the solution is 93° C. and the etching rate is 0.0025 mm/min. The total immersion time can be controlled to remove a predetermined wall thickness of the dome section, for example, where the wrinkled textures are most prominent. The predetermined thickness may be the thickness of the internal removal, the external removal or a summation of both.

Figure 2C:
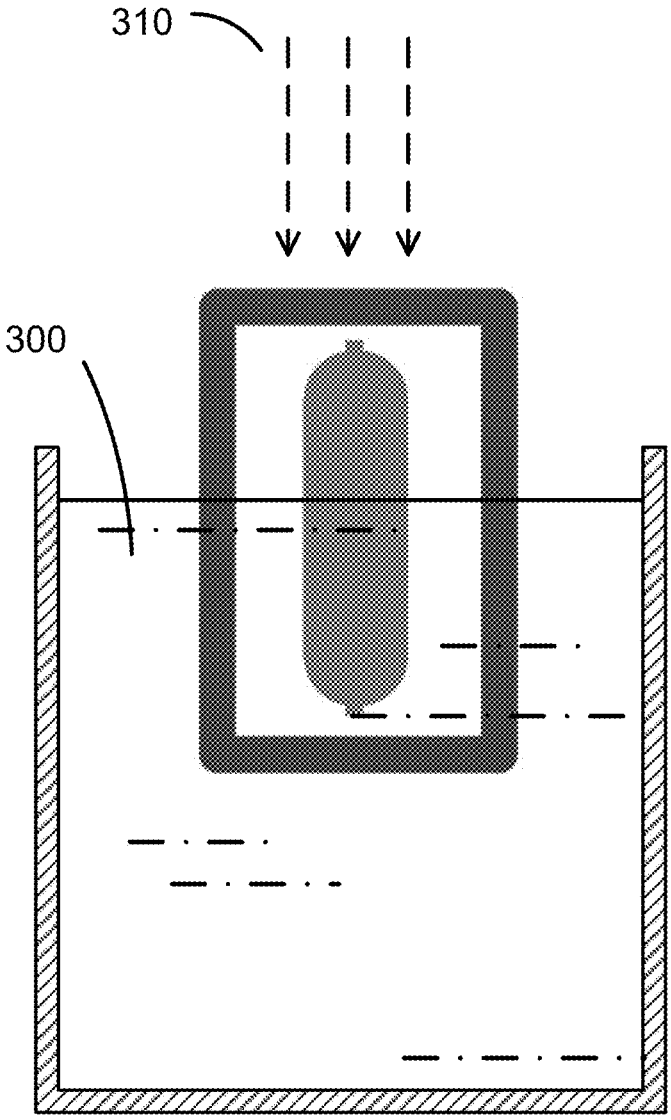

In a third step illustrated in FIG. 2C, the unit of the rack 200 and the metal liner 100 housed therein is lifted from the bath of the etching solution 300. The metal liner 100 is showered through the rack 200 with water 310 at room temperature, such as tap water, as the unit is being lifted. One reason for this water showering is explained as follows. Even during the lifting up, the chemical reaction continues between the etching solution 300 remaining inside the metal liner 100 and the inner surface thereof, causing the etching solution 300 to spout out through the top neck section. The spouting out solution flows down to further dissolve the outer surface of the metal liner 100 uncontrollably; thus, the water 310 is poured to slow down the chemical reaction while the unit is being lifted. Another reason for this water showering is that it can lower the temperature of the etching solution 300, reducing the evaporation of the solvent, thereby suppressing the increase of the NaOH concentration. As a result of the water showering during the lifting, random variations in wall thickness especially in the body section of the metal liner 100 get reduced, and thus the wall thickness can be controlled to be within set tolerances.

Figure 2D:
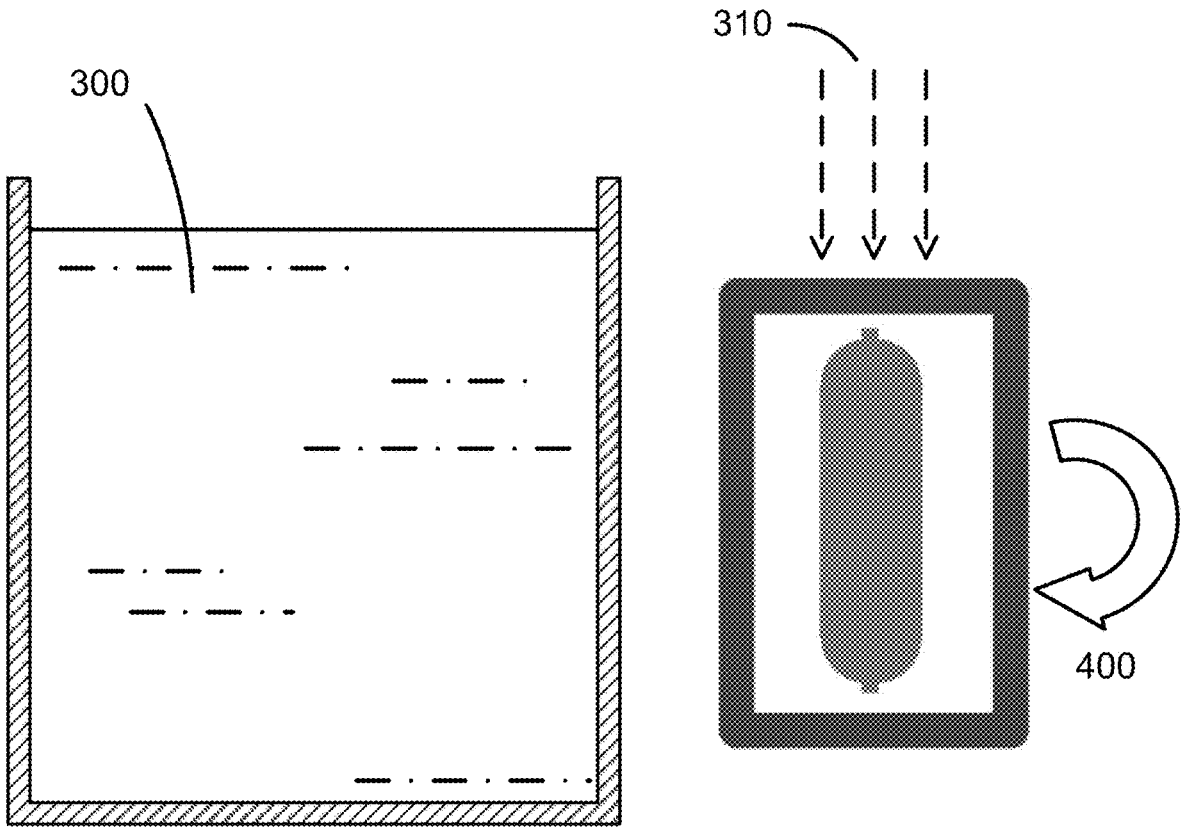

In a fourth step illustrated in FIG. 2D, the unit of the rack 200 and the metal liner 100 housed therein is entirely placed outside the bath of the etching solution 300; and the metal liner 100 is washed by using water 310 at room temperature such as tap water, especially thoroughly the inner surface thereof. During or after the washing, the unit of the rack 200 and the metal liner 100 housed therein is rotated vertically by 180°, as depicted by an arrow 400 in FIG. 2D, so as to orient the metal liner 100 with the top and bottom neck sections flipped vertically. The process from the second step (FIG. 2B)—the fourth step (FIG. 2D) is repeated for the unit of the rack 200 and the metal liner 100 housed therein, with the new orientation as above. That is, the unit is immersed in the bath of the etching solution 300, showered with water 310 as being lifted from the bath, placed outside the bath and washed by water 310.

In a fifth step, the surface textures and thicknesses at various locations of the metal liner 100, in particular, at the top and bottom dome sections, are inspected and measured. The above process steps can be repeated, with either of or both the orientations, using the same or revised process parameters, as many as needed until a predetermined smoothness is obtained. That is, each cycle includes the immersion for a certain length of immersion time that can be adjusted according to the measured thicknesses, the water showering while the unit is being lifted from the bath, the washing the metal liner 100 with water, especially well the inside thereof, and the measurement of wall thicknesses at predetermined locations of the metal liner 100. In addition to the immersion time, other process parameters, e.g., the etching temperature, the concentration of the etching solution, etc., may also be adjusted depending on the measurement results. Whether the predetermined smoothness has been obtained can be judged by the reduced thicknesses at predetermined locations based on the measurements, estimates, visual inspections of the surface smoothness to see if the wrinkled textures have been removed especially from the dome sections, any combination thereof, or other predetermined metrics. Here, the reduced thickness may be estimated by a preset etching rate times the total immersion time.

Figure 2E:
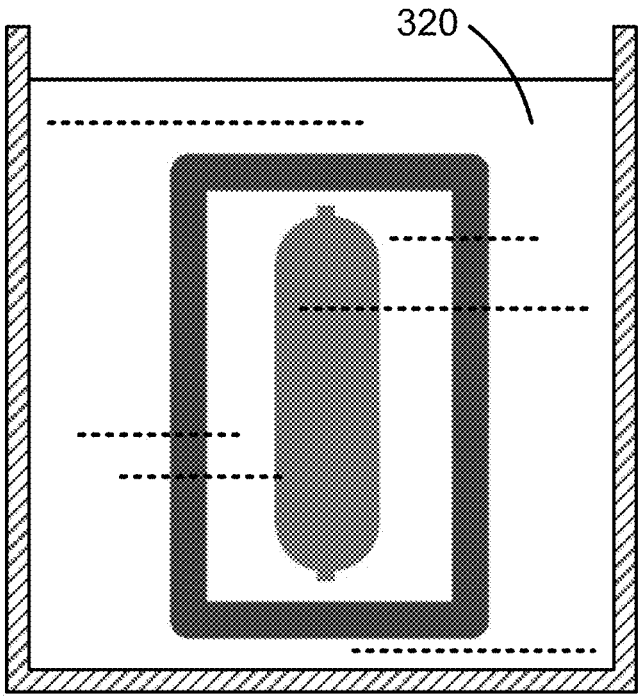

In a sixth step illustrated in FIG. 2E, deoxidization of the metal surface is carried out by immersing the unit of the metal liner 100 and the rack 200 in the bath of a deoxidizing solution 320, which may be also effective for desmutting. In the present example, the deoxidizing solution is nitric acid ($HNO_3$)-based. For the case of aluminum or aluminum alloy, nitric acid ($HNO_3$) is an effective deoxidizing agent, since it removes the oxygen content generated on the surface during the chemical etching, without reacting with aluminum itself; that is, nitric acid is suited for non-etching deoxidizing of aluminum surfaces. The temperature of the deoxidizing solution can be a room temperature; the length of the immersion time for the deoxidization can be adjusted experimentally and/or visual inspections.

Figure 2F:
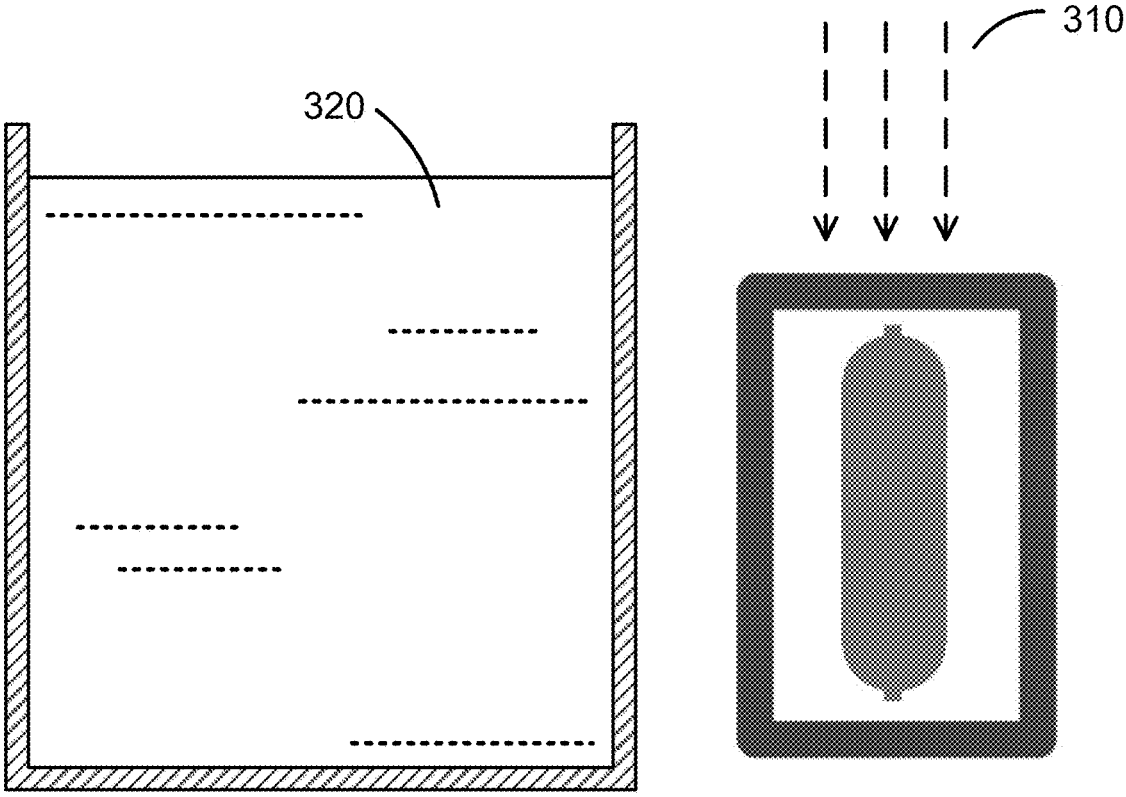

After the deoxidization, in a seventh step illustrated in FIG. 2F, the unit of the rack 200 and the metal liner 100 housed therein is taken out of the bath of the deoxidizing solution 320; the metal liner 100 is washed by using water 310 at room temperature such as tap water.

Figure 2G:
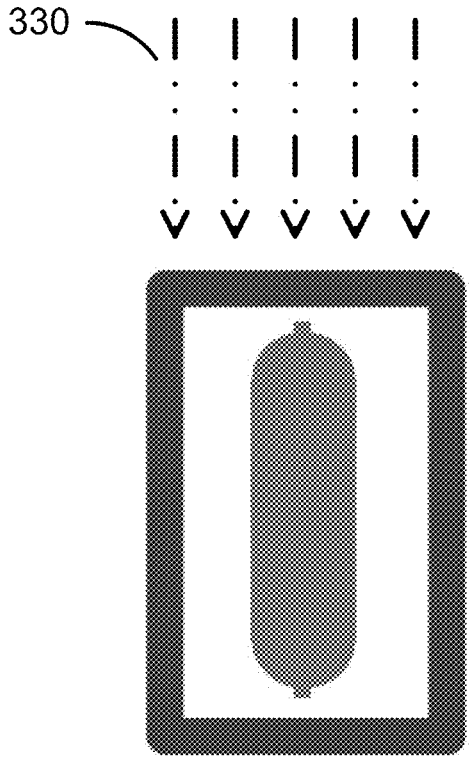
Figure 2H:
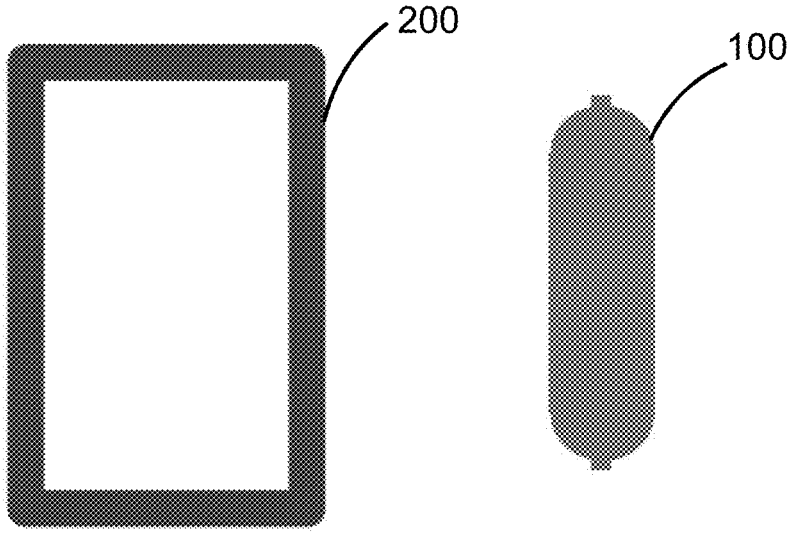

After the washing by water, in an eighth step illustrated in FIG. 2G, the metal liner 100 is finally rinsed by using a deionized water. This step is carried out for the purpose of further fine-tuning the surface quality. After the rinsing, in a ninth step illustrated in FIG. 2H, the metal liner 100 is taken out of the rack 200, followed by final inspections of the finished surfaces.

In the above example process, the metal liner 100 subject to the chemical milling has two neck sections at the top and bottom ends. However, the process can be revised for a metal liner having one neck section at one end and a closed bottom surface at the other end of the cylindrical body. For example, the step of water showering while the unit is being lifted, illustrated in FIG. 2C for the case of the metal liner 100 with two neck sections, can be carried out by tilting the metal liner with one neck section to pour out the etching solution 300 remaining inside while the unit is being lifted; and the step of vertically rotating the unit by 180°, illustrated by the arrow 400 in FIG. 2D, can be eliminated. In another example, the rack 200 may be configured to hold the metal liner with one neck section substantially horizontal, i.e., the orientation with the neck section pointing sideway, so that the etching solution 300 flows out by itself while the unit is being lifted in the step of water showering.

Although the entire metal liner 100, inside and outside, is subject to the etching solution and washing liquids, the present chemical milling is especially effective for removing the wrinkled-texture layer including microscopic folds and wrinkles on the surface. It should be noted that the present method allows for repetition of some steps, such as the immersion in the bath of the etching solution, the water showering while the unit is being lifted from the bath, the washing the metal liner 100 with water, and the measurement of wall thicknesses at predetermined locations of the metal liner, until a predetermined smoothness is obtained. Each subsequent cycle can be carried out with a revised length of immersion time adjusted according to the measurement results of the thicknesses. Other process parameters, such as the etching temperature, the concentration of the etching solution, etc., may also be adjusted as needed. Whether the predetermined smoothness has been obtained can be judged by the reduced thicknesses at predetermined locations based on the measurements, estimates, visual inspections of the surface smoothness to see if the wrinkled textures have been removed especially from the dome section, any combination thereof, or other predetermined metrics. Here, the reduced thickness may be estimated by a preset etching rate times the total immersion time.

Figure 3A:
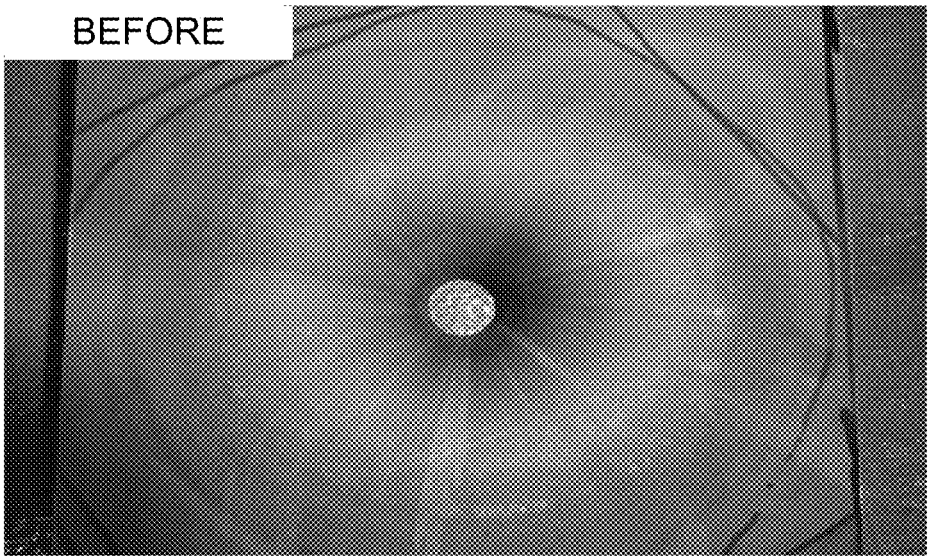
FIGS. 3A and 3B are photos of the inner surface of the dome section as seen from inside along the cylindrical axis of the metal liner toward the internal opening of one of the neck sections, showing the surface quality before and after the present process, respectively.
Figure 3B:
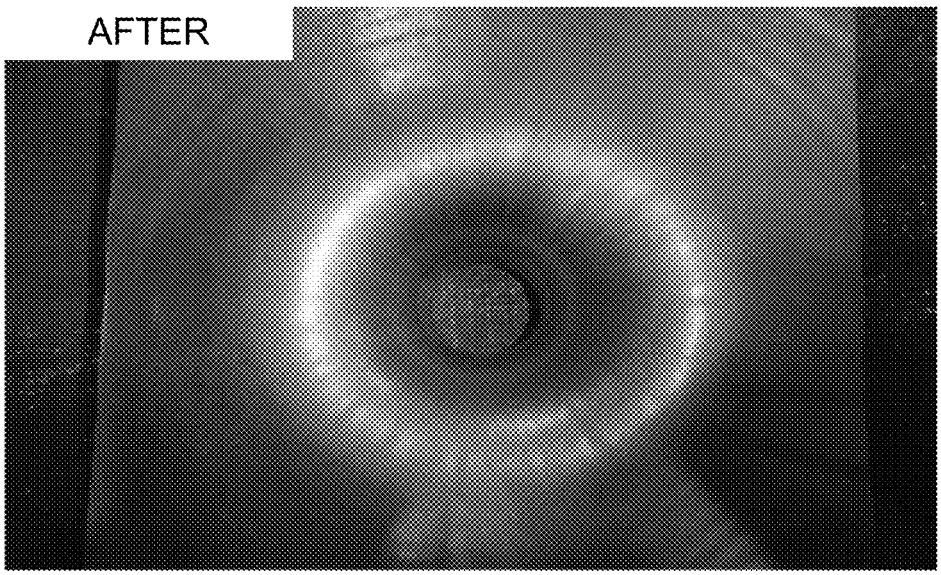

FIGS. 3A and 3B are photos of the inner surface of the dome section as seen from inside along the cylindrical axis of the metal liner 100 toward the internal opening of one of the neck sections, showing the surface quality before and after the present chemical milling process, respectively. It can be visually observed that the surface after the process is shiny and smooth compared to the surface before the process.

Figure 4A:
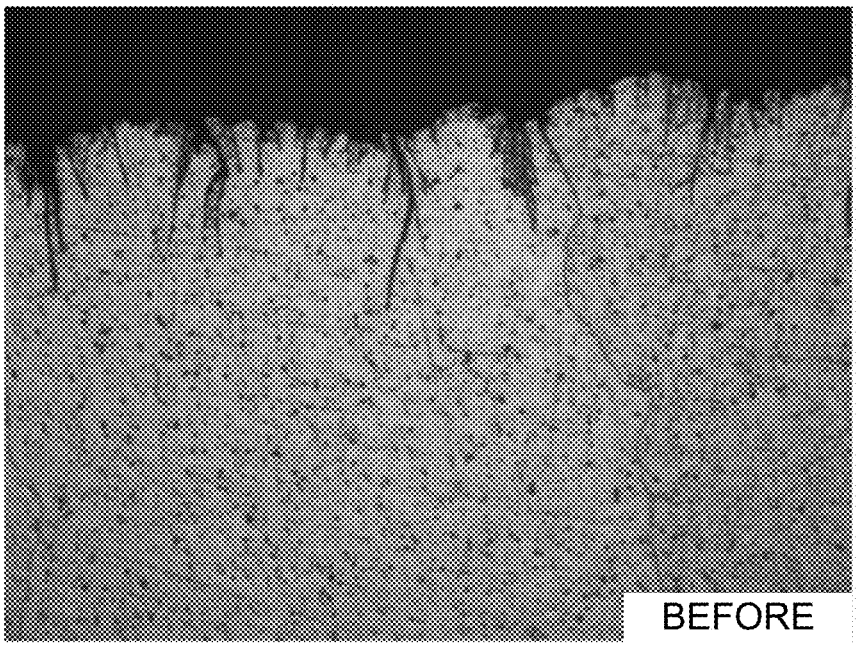
FIGS. 4A and 4B are magnified photos of the cross-section of part of the inner surface of the dome section, showing the surface quality before and after the present process, respectively.
Figure 4B:
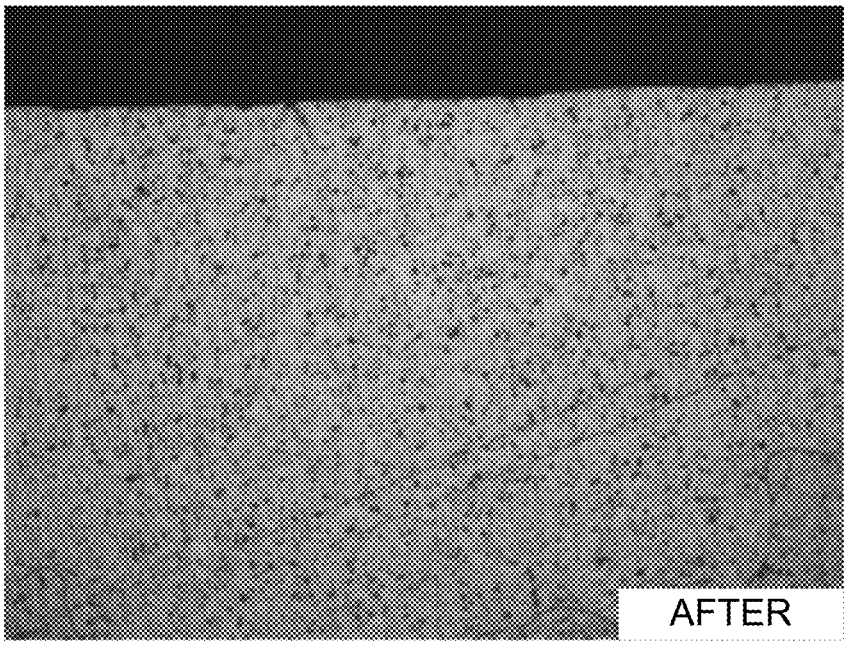

FIGS. 4A and 4B are magnified photos of the cross-section of part of the inner surface of the dome section, showing the surface quality before and after the present chemical milling process, respectively. FIG. 4A shows that the surface wrinkles and folds, resulted from the plastic deformation to form the metal liner 100, remain as they are, giving the rough surface texture. FIG. 4B shows that the wrinkles are significantly reduced after the process, providing the smooth texture on the surface. In one example, the depth of removed wrinkles reached 0.3 mm at maximum.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed is:

1. A method for surface-finishing one or more metal liners, each of which is formed by plastic deformation to be axially symmetric in shape, comprising a body section shaped to be a generally hollow cylinder with a predetermined wall thickness elongated in an axial direction; at least one dome section formed seamlessly contiguous to one end of the body section; and at least one neck section that is extruded seamlessly contiguous to the at least one dome section to form a generally narrow tube having a passage therein to channel a content, wherein the surface has wrinkled textures generated during the plastic deformation, the method comprising:

chemical milling, wherein the method comprises:

housing the one or more metal liners in a rack to hold and secure the one or more metal liners therein to have a unit of the rack and the one or more metal liners housed therein;

first immersing the unit in a bath of an etching solution for the chemical milling for a length of immersion time;

showering with water the one or more metal liners of the unit while the unit is being lifted from the bath;

first washing with water the one or more metal liners of the unit placed outside the bath of the etching solution;

measuring wall thicknesses at predetermined locations of the one or more metal liners;

repeating the first immersing through the measuring until a predetermined smoothness is obtained, wherein the length of immersion time is adjusted according to the measured thicknesses;

second immersing the unit in a bath of a deoxidizing solution;

second washing with water the one or more metal liners of the unit placed outside the bath of the deoxidizing solution;

rinsing with deionized water the one or more metal liners of the unit; and taking out the one or more metal liners from the rack.

2. The method of claim 1, wherein each of the one or more the metal liners has two dome sections formed seamlessly contiguous to top and bottom ends of the body section, respectively, and two neck sections that are extruded seamlessly contiguous to the two dome sections, respectively, the method further comprising, during or after the first washing:

rotating the unit vertically by 180° to have an orientation of the unit with a top and a bottom flipped vertically; and repeating the first immersing, the showering and the first washing, for the rotated unit.

3. The method of claim 1, wherein the housing includes holding the at least one neck section of each of the one or more metal liners by using at least one inwardly extended arm attached internally to the rack.

4. The method of claim 1, wherein the one or more metal liners are made of aluminum alloy;

the rack is made of iron;

the etching solution is based on sodium hydroxide; and the deoxidizing solution is based on nitric acid.

5. The method of claim 1, wherein whether the predetermined smoothness is obtained is judged by the reduced thicknesses at predetermined locations based on the measurements, estimates, visual inspections of surface smoothness, or a combination thereof.

6. The method of claim 5, wherein the reduced thickness is estimated by a preset etching rate times the total immersion time.

* * * * *